US007156536B1

(12) United States Patent
McCorkle

(10) Patent No.: US 7,156,536 B1
(45) Date of Patent: Jan. 2, 2007

(54) FLASHLIGHT HOLDER FOR A HELMET

(76) Inventor: Christopher McCorkle, 3236 E. Sells, Phoenix, AZ (US) 85018

( * ) Notice: Subject to any disclaimer, the term of this patent is extended or adjusted under 35 U.S.C. 154(b) by 0 days.

(21) Appl. No.: 11/056,836

(22) Filed: Feb. 11, 2005

(51) Int. Cl.
*F21V 21/084* (2006.01)

(52) U.S. Cl. ..... 362/106; 362/191; 362/396; 224/181

(58) Field of Classification Search ..... 362/105, 362/106, 191, 396; 2/6.2, 422; 224/181; D26/138
See application file for complete search history.

(56) References Cited

U.S. PATENT DOCUMENTS 5,438,494 A 8/1995 Harlan
5,608,919 A 3/1997 Case
5,658,065 A * 8/1997 Jamieson ..... 362/106
5,664,868 A 9/1997 Montalbano et al.
6,616,294 B1 9/2003 Henry

* cited by examiner

*Primary Examiner*—Stephen F Husar
(74) *Attorney, Agent, or Firm*—Gregory J. Nelson

(57) ABSTRACT

A light holder for a brimmed helmet of the type worn by firefighters. The holder has an aperture for receiving the barrel of a light. A mounting slot extends angularly with respect to the aperture so when the slot is engaged with the brim, the light is maintained at eye level disposed below the brim and in an out-of-the-way position to minimize the possibility of snagging. Set screw or other fasteners may be provided for securement of the light to the holder and the holder to the helmet.

9 Claims, 4 Drawing Sheets

FLASHLIGHT HOLDER FOR A HELMET

FIELD OF THE INVENTION

The present invention relates to a flashlight holder and more particularly to a flashlight holder for headgear, particularly protective helmets such as those worn by firefighters and others.

BACKGROUND OF THE INVENTION

Flashlights are widely used by construction workers, miners, firefighters and others who, in the course of performing their duties, require the illumination of a light. Miners and construction workers often work in dark or dimly lit areas. Firefighters often enter dark or smoke-filled areas and these individuals require light for illumination and also require the ability to use both hands to perform their duties. If it becomes necessary for these individuals to hold a flashlight in one hand for illumination, their ability to effectively and safely operate equipment and perform is seriously impaired.

Accordingly, lights have been secured to the front of mining helmets and other types of helmets or hard hats used in mining and construction fields. More recently, various brackets and holders have been developed which are more specifically for helmets of the type worn by firefighters.

For example, U.S. Pat. No. 5,664,868 discloses a helmet flashlight bracket that is replaceably attachable to the brim of a helmet and which may secure a flashlight. The flashlight bracket is adapted to receive a flashlight having a handle and a light emitting portion so the light beam points substantially at eye level. The flashlight bracket includes a faceplate, a flashlight maintaining apparatus, a C-shaped channel and a faceplate clamping apparatus. The bracket is disposed on the faceplate and is adapted to receive the handle of a flashlight. The C-shaped channel is disposed on a lower portion of the faceplate and cooperates with the faceplate clamping apparatus to clamp the flashlight to the helmet.

U.S. Pat. No. 6,616,294 discloses a flashlight holder for use with a hard hat which receives a flashlight of the type having a faceted barrel and a rotatable head. The flashlight holder is designed so that the flashlight is operable by one hand when retained in the holder. The holder defines a barrel support secured to the base. The barrel support defines an interior surface and a slot configured to cooperate to closely receive and retain the flashlight barrel in a non-rotatable manner. The base of the flashlight holder defines a tab configured to be releasably engaged within a slotted receptacle defined by the hard hat. A locking projection extends from the tab for engaging the lower edge of the hard hat.

U.S. Pat. No. 5,608,919 entitled "Helmet Flashlight Retainer" shows a web-type mounting pad for a mini-flashlight which is removably secured to a helmet by elastic straps having hooks that clip to the helmet rim. In one embodiment, three straps secure the mounting pad. In another embodiment, a slidable mounting pad slides on one or more elastic straps. In another embodiment, a snap on a Velcro® band holds a removeable, Velcro® mounting pad and a tether secures the hand-held flashlight to the helmet.

U.S. Pat. No. 5,438,494 discloses a headgear light holder having a leaf spring strap that is sized and shaped to be wrapped around the outside periphery of a flashlight body. Straps on the opposite ends of the leaf spring are extended to an axis of cylindrical shape of the leaf spring strap at positions between which a gap having a selected width is provided for drawing the opposite ends of the leaf spring together to tighten the inside periphery of the leaf spring strap against the outer periphery of the flashlight body. At least one fastener orifice is provided in each of the opposite ends of the leaf spring strap. A threaded end of a fastener shaft is inserted through a fastener orifice in each of the ends of the leaf spring strap. A mating, threaded fastener is screwed onto the fastener shaft, such as at the opposite ends of the leaf spring strap, are drawn together in a gap to tighten the leaf spring onto the flashlight body. The fastener shaft can be a fastener bolt positioned each on an opposite side of a firefighter helmet to hold a faceplate on the helmet.

From the foregoing, it is apparent that various developments and innovations for light holders for use in connection with various types of headgear can be found in the prior art. There nevertheless exists the need for a simple, removable and easily attachable light holder which can be used with helmets of the type worn by firefighters which is efficient, effective and minimizes safety hazards.

BRIEF SUMMARY OF THE INVENTION

Briefly, the present invention provides a flashlight holder that is attachable to the brim of a headgear of the type worn by firefighters, as well as other types of helmets having a crown with an extending brim. The holder minimizes hazards, as it will not become easily dislodged nor is it subject to engagement or entanglement in structure or wiring that the wearer may encounter.

The present invention accomplishes the above by providing a holder which is a unitary, one piece structure fabricated from a suitable fire-resistant material such as aluminum. The holder has a body which defines an aperture to receive the handle of a flashlight.

In one embodiment, the configuration of the aperture is multi-faceted to conform to the polygonal configuration of a flashlight handle of the type preferred by firefighters. The handle is inserted into the aperture and frictionally engaged to retain the light in place. The polygonal configuration of the aperture prevents the flashlight from rotating. Securement means extends through the body intercepting the flashlight receiving aperture. The securement means may consist of threaded bores which receive suitable fasteners such as allen head screws. Fasteners of this type are preferred since once tightened they do not project above the surface of the holder. The holder is secured to the helmet by an open slot which extends into the body. The slot may be engaged with the brim of the helmet and secured to the helmet by a suitable fastener. Again, the fastener may comprise a threaded bore which receives allen head screws.

An important feature of the invention is the orientation of the slot relative to the aperture. The orientation of the slot defines an acute angle with respect to an axis of the flashlight-receiving aperture so that, once mounted, the flashlight is maintained in a position extending along and beneath the lower edge of the helmet brim at eye level.

In alternate embodiments, the fastener which secures the holder to the helmet may be a cam-type lock or a spring-biased jaw which may be operated by the wearer to install and remove the bracket from the helmet or to adjust the position of the bracket along the helmet brim.

Accordingly, it is an object of the present invention to provide a flashlight holder for a helmet that is simple in construction, inexpensive to manufacture and effective for the intended purpose.

It is another object of the present invention is to provide a helmet holder that is removably securable to a helmet such as a firefighter's helmet requiring minimal tools.

Another object of the present invention is to provide a flashlight holder for a helmet which optimally positions the light aligned with the wearer's line of sight.

It is yet another object of the present invention to provide a light holder for a helmet which minimally projects from the helmet to prevent interference, snagging, entanglement or engagement with structures or wiring that the wearer may encounter in the course of performing his or her duties.

BRIEF DESCRIPTION OF THE DRAWINGS

The present invention will be more fully understood with reference to the following detailed description and claims in conjunction with the drawings in which:

The present invention will be described for use in conjunction with a helmet of the type worn by firefighters. It is to be understood that the holder may be used with other types of headgear having a brim such as construction hard hats and miner's hard hats.

Figure 7:
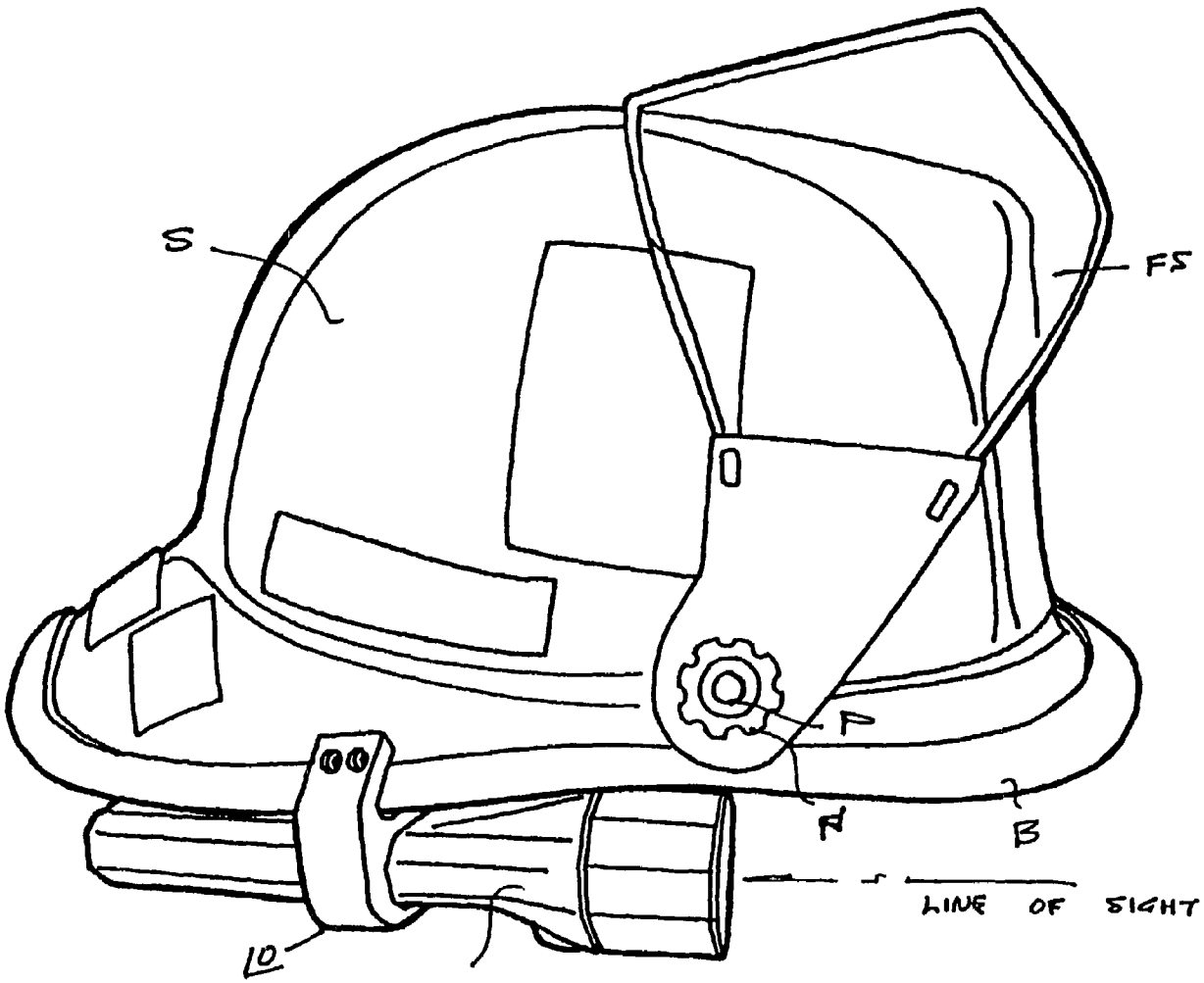
FIG. 7 is a perspective view showing the holder and contained flashlight secured to a helmet of the type worn by firefighters.
Figure 8:
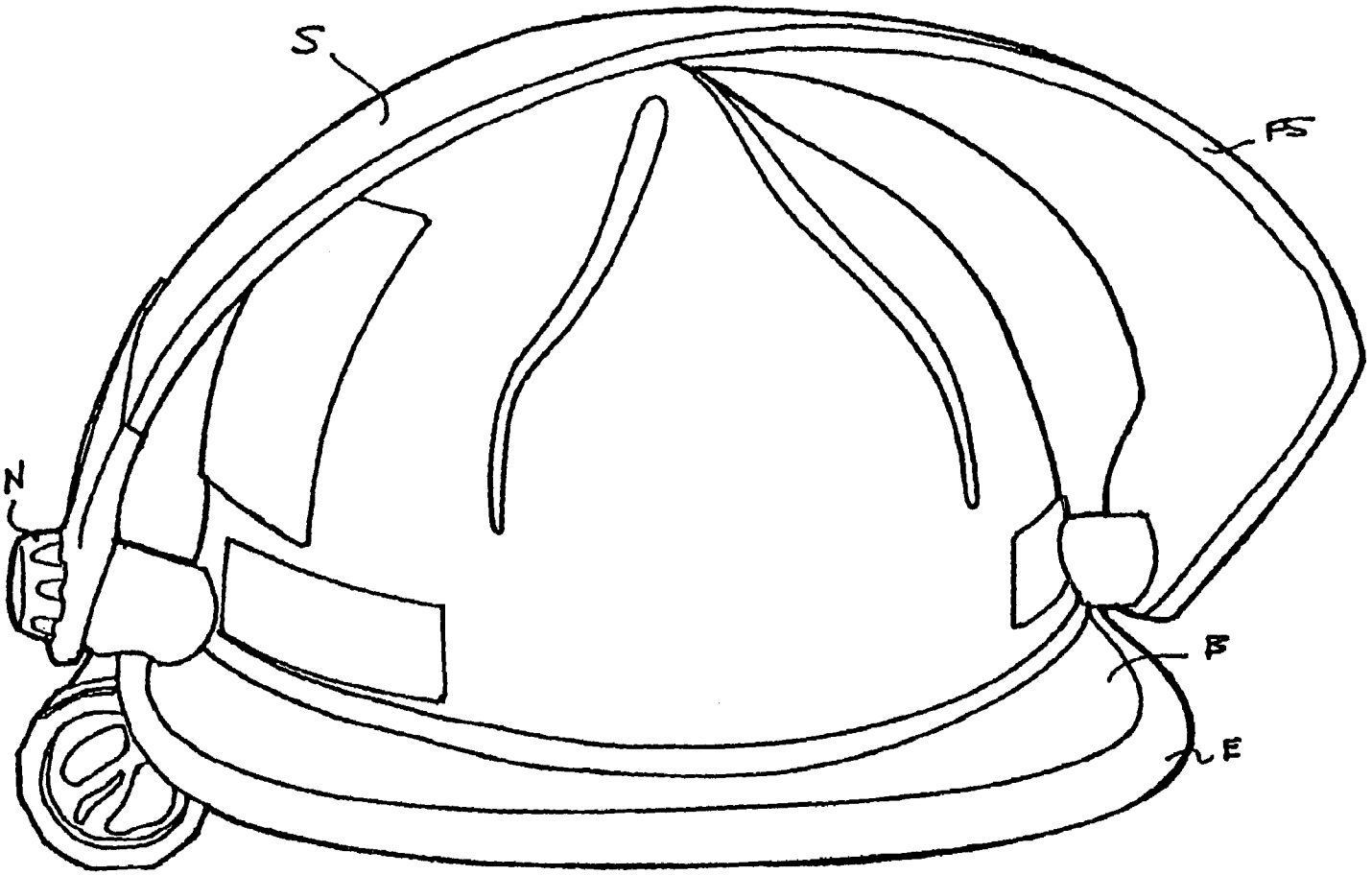
FIG. 8 is a front view of a firefighter's helmet showing a flashlight which is secured to the rim by the holder of the present invention oriented in a line of sight position.

Firefighter's helmets generally, as seen in FIGS. 7 and 8, generally have a hard shell S which receives the head of the wearer. The hard shell S is generally made of a high performance thermoplastic and has a transparent face shield FS which is adjustable at pivot locations P at the side of the helmet. The face shield can be elevated to a position above the eyes of the wearer or to a position in front of the wearer's eyes.

In FIGS. 7 and 8, the shield is shown in an elevated position. The shield may be locked in one of a selected position by nuts N.

The shell is generally adjustable to the wearer's head size and includes a resilient cushioning or impact-absorbing material. An ear or neck protector of a material such as Nomex® may be attached to the liner. A chin strap is provided to secure the helmet in place. These are not shown as they are common features of helmets of this tyep. The bottom of the shell S terminates at an outwardly extending brim B which extends entirely around the shell and may project rearwardly a distance to protect the ear and neck areas of the wearer. The edge of the brim may have a circumferentially extending, resilient edging bead E, as shown.

Helmets of the general type described above are available from various manufacturers such as those available from Carnes & Brothers and designated the Phenix 1500 with face shield. Other manufacturers of fire helmets include E.D. Bullard Company and The Mine Safety Appliance Company.

The foregoing description of fire helmets is provided as general background to facilitate the understanding and the advantages of the present invention. Again, as pointed out above, while the holder of the present invention has particular application for use in connection with fire helmets, it is being understood the holder may be used with various type helmets having the general features set forth above.

DETAILED DESCRIPTION OF THE DRAWINGS

Turning now to the drawings, particularly FIGS. 1 to 9, the holder of the present invention is generally designated by the numeral 10 and is shown having a one-piece or integral body 12. The body 12 has a flashlight receiving section 14 and a mounting section 16. The body has a generally planar top wall 18, sidewall 20, rounded edge 22 which converges into planar wall section 24.

A mounting slot 30 extends upwardly from wall 24 and is defined by spaced-apart sidewalls 32, 34. Sidewalls 32, 34 converge at inner or lower end 36. The width of the slot is selected to conform to the thickness of the peripheral edge E of the helmet on which the bracket is to be installed. A flange 40 extends parallel to the slot and is defined by walls 34 and 35. The upper end of the flange wall 35 converges at rounded corner 32 into wall 18.

In the flashlight receiving section, an aperture 50 is formed. The aperture 50 may have various geometric shapes but is shown as having facets or faces 52, 54, 56, 58, 60, 62 and 64. Each of the facets or faces are generally planar and together form a polygonal shape, in this case an elongated octagonal shape.

The flashlight receiving aperture 50 may be other shapes to conform to the style of flashlight F with which the holder is to be used. A generally preferred flashlight used by firefighters is a flashlight manufactured by Pelican, Model 2400. The Pelican flashlight has a body with an elongated handle section which is polygonal and has a head end having a lens. The polygonal shape is preferred because it minimizes slipping. Further, when the handle of the light is inserted into the aperture, the shape will also resist rotation.

Figure 1:
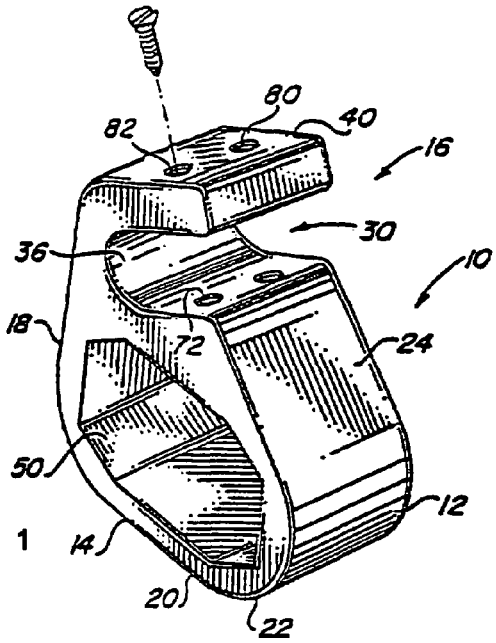
FIG. 1 is a perspective view of the holder of the present invention.
Figure 2:
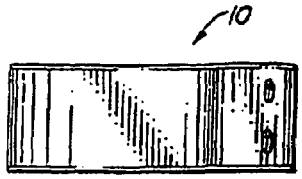
FIG. 2 is a top view thereof.
Figure 5:
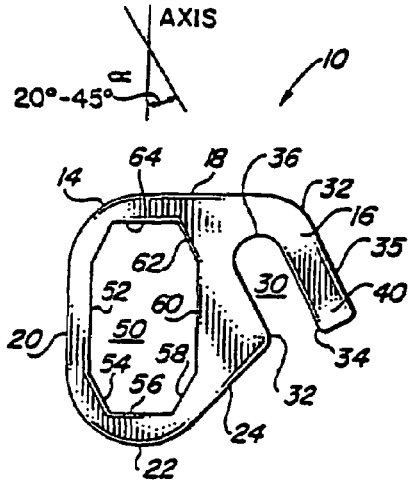
FIG. 5 is a right side view of the holder of the present invention with the left side being the mirror image thereof.
Figure 3:
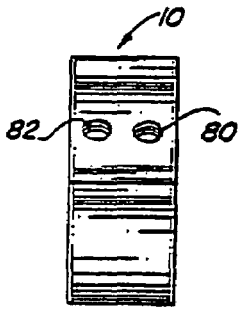
FIG. 3 is a front view thereof.
Figure 4:
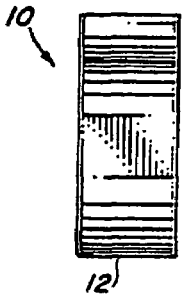
FIG. 4 is a rear view thereof.
Figure 6:
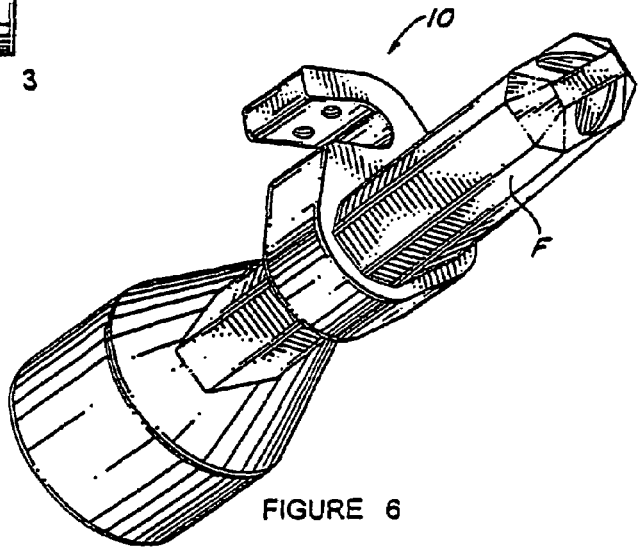
FIG. 6 is a perspective view showing a flashlight with the holder of the present invention secured about the handle or body of the light.

As mentioned above, the orientation of the slot 30 relative to the aperture 50 is an important feature of the invention. As seen in FIG. 5, the walls 32 and 34 of slot 30 are angularly positioned relative to the facets or walls 52 and 60 of the aperture. Thus, the axis of the slot 30 forms an angle with respect to the axis of the aperture 50 which extends parallel to the longer faces 52, 60. This angle alpha is an acute angle approximately between 20° and 45°. The depth of the slot 30 extends approximately to the location of facet or wall 62. Accordingly, when the bracket 10 is engaged with the brim of the helmet, as shown in FIG. 7, the aperture 50 is disposed so the flashlight is maintained extending forwardly beneath the brim B of the helmet. Further, the distance between the wall 60 of the aperture and the bottom 36 of the slot is relatively small being less than 1 centimeter so that the flashlight F is maintained in a position in which the body of the flashlight is beneath the brim so three point contact exists between the flashlight and the rim for added security. Also note in this position, the light is maintained by the bracket in a position in which it does not project substantially beyond the helmet edge minimizing the possibility of snagging or engaging structure or wires in the area in which the firefighter is working.

Another important feature of the present invention is illustrated in FIGS. 7 and 8 where it will be seen that the lens of the flashlight F is at an elevation which is parallel and aligned with the line of sight of the wearer. Thus, the face shield FS of the helmet may be placed in the lowered position in front of the face of the wearer and the holder and the light will not interfere with the normal use of the shield. The light being in a line of sight position will move with the wearer's head with the beam of the light oriented at the area which the wearer is viewing. Also note that flange 40 and edge E as well as the rounded corners of the bracket also contribute to safety and minimization of snagging or engagement with objects.

As indicated above, the light may be frictionally held within the aperture, but it is preferred that fasteners be provided to provide additional securement. Accordingly, a pair of threaded bores 70, 72 extend through wall 32 and intercept the aperture 50. The threaded bores receive fasteners shown as allen head screws such as screw 76. The allen head screws 76, 78 can be tightened using a conventional allen head wrench to bring the screws into retaining engagement with the flashlight in the holder. When tightened, the allen head screws will be recessed below the planar surface of wall 32 not interfering with positioning of the brim within the slot.

The holder is secured to the helmet brim B by engagement with slot 30 and further held in position by a fastener arrangement. Threaded bores 82, 84 are provided in flange 40 at an intermediate location and receive fasteners such as alien head screws 76. Again, the allen head screws may be tightened into engagement with the brim of the helmet using a conventional allen head wrench. Once tightened, the screws will not project above the surface of flange 40.

The use of threaded fasteners, as set forth above, is an effective means of securing the bracket to the helmet and requires only an allen head wrench and minimal time in which to secure, remove or adjust the bracket. Note once in position, the bracket can be adjusted forwardly or rearwardly along the brim in accordance with the preference of the wearer.

Figure 9:
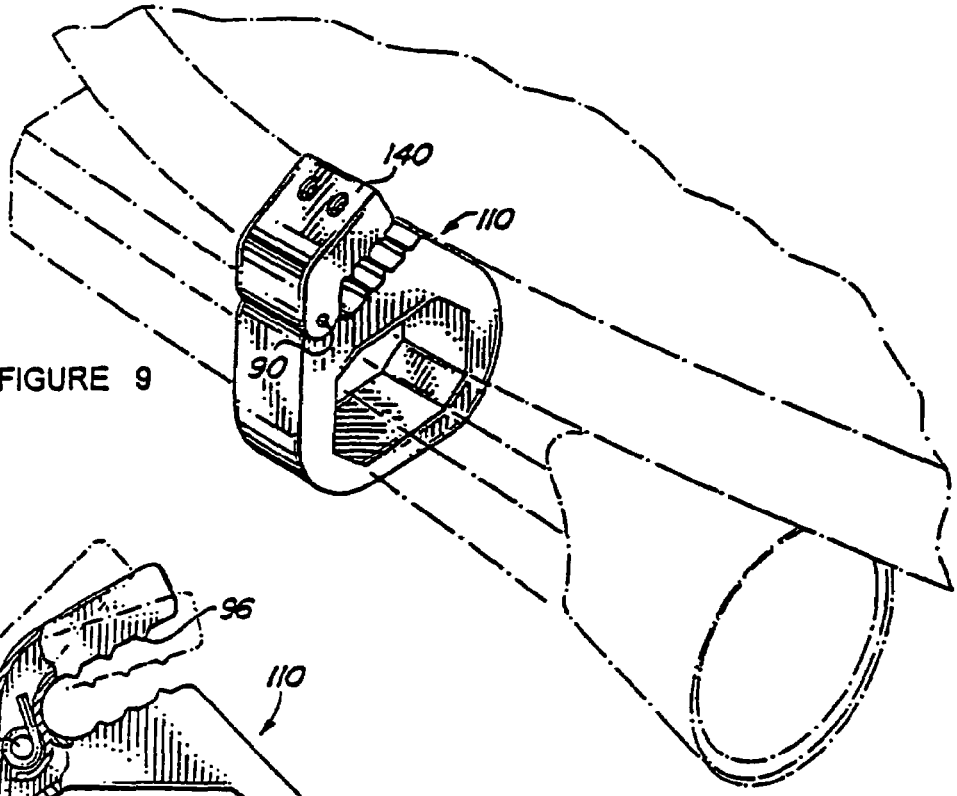
FIGS. 9 and 10 show alternative means of fastening the holder to a helmet.
Figure 10:
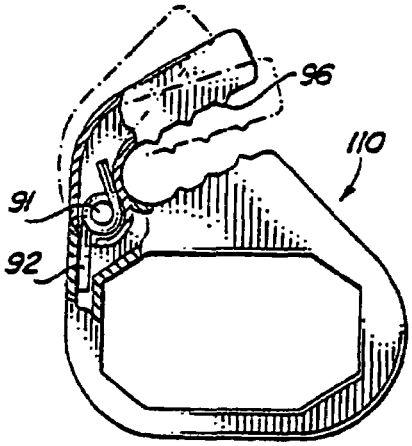
Figure 11:
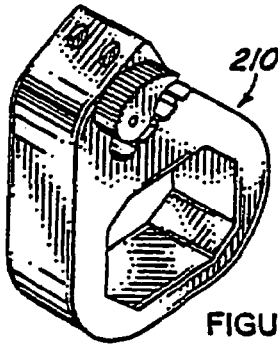
FIGS. 11 and 12 show yet another embodiment of the present invention utilizing a cam lock.
Figure 12:
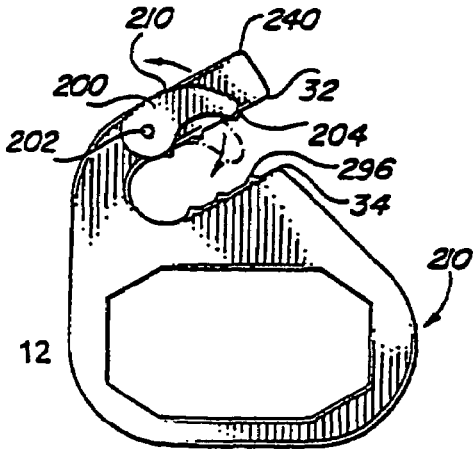

However, other means of fastening the bracket to the brim of the helmet. For example, the flange 140, as seen in FIGS. 9 and 10, may be pivotally secured to the body of the holder 110 at pivot 90. The flange 140 pivots on a pivot shaft 91 and a torsion spring 92 provides a biasing force to bring the flange into engagement with the upper surface of the helmet rim. The inner surfaces of the flange may be provided with raised areas 96 for better frictional engagement. The holder 110 is otherwise configured as described above.

In FIG. 10, another fastener arrangement is shown in which the flange 240 receives a rotatable cam 200. The cam 200 is rotatable about pivot shaft 202 and has a locking surface 204 which is engageable with the helmet brim B. The cam has a surface 210 which may be manually engaged to rotate the cam 200 between a locked and an unlocked position. Again, the interior surfaces of the slot 230, namely walls 32 and 34, may be provided with raised areas 296 for increased frictional engagement with the helmet.

From the foregoing, it will be seen that an improved light holder for helmets has been described. The holder has a number of advantages, it is a one-piece construction which is easily securable and attachable from the helmet. The holder provides safety features and secures the light in a convenient position generally aligned with the eye level of the wearer. The bracket secures the light in a manner that the light is in three point contact with the helmet making it more secure and less subject to being dislodged during use.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A holder for securing the body of a flashlight to the brim of a helmet having an edge comprising:

(a) a body defining an aperture configured to conform to the cross-sectional shape of the flashlight body; and (b) said body defining a mounting slot angularly positioned with respect to said aperture and engageable with said brim whereby the flashlight is held in a position beneath the brim substantially at the wearer's eye level and not extending substantially past the edge of the brim.

2. The holder of claim 1 wherein the body is metal.

3. The holder of claim 1 wherein said aperture is polygonal.

4. The holder of claim 3 wherein said mounting slot is at an acute angle with respect to an axis of said aperture.

5. The holder of claim 1 further including fastening means for securing a flashlight in said aperture.

6. The holder of claim 1 further including fastener means cooperating with the mounting slot and engageable with the brim for securing said holder to a helmet brim.

7. The holder of claim 5 wherein said fastening means comprises recessed set screws.

8. The holder of claim 6 wherein said fastener means comprises a locking cam.

9. The holder of claim 6 wherein said fastener means comprises a pivotal jaw.

* * * * *